US005979009A

United States Patent [19]

Polzin et al.

[11] Patent Number: 5,979,009

[45] Date of Patent: Nov. 9, 1999

[54] ROLLER HAVING SLIP-ON CAGE FOR PAINT ROLLER COVER

[75] Inventors: Bruce C. Polzin, Greendale; Robert A. Shaffer, Kenosha; David L. Prins, Franksville, all of Wis.; Rand J. Krikorian, Greensboro, N.C.; William W. Barton, Greendale; Anthony W. Gilbert, New Berlin, both of Wis.

[73] Assignee: Newell Operating Co., Freeport, Ill.

[21] Appl. No.: 08/907,847

[22] Filed: Aug. 8, 1997

Related U.S. Application Data

[63] Continuation-in-part of application No. 08/767,580, Dec. 16, 1997, which is a continuation-in-part of application No. 08/383,878, Feb. 6, 1995, Pat. No. 5,584,092.

[51] Int. Cl.[6] ..... B05C 17/02

[52] U.S. Cl. ..... 15/230.11; 492/13; 492/19; 492/45

[58] Field of Search ..... 15/230.11; 492/13, 492/14, 19, 45

[56] References Cited

U.S. PATENT DOCUMENTS

| | | | |
|---|---|---|---|
| D. 269,650 | 7/1983 | Allison | D4/122 |
| D. 293,860 | 1/1988 | Smith | D4/122 |
| D. 305,080 | 12/1989 | Morgan et al. | D4/122 |
| D. 323,246 | 1/1992 | Best et al. | D4/122 |
| 329,601 | 11/1885 | Smith | 492/32 |
| D. 376,911 | 12/1996 | Zigelboim et al. | D4/122 |
| 2,520,863 | 8/1950 | Thomas et al. | 15/230.11 |
| 2,669,743 | 2/1954 | Coughlan | 15/230.11 |
| 2,675,605 | 4/1954 | Thomas | 492/19 |
| 2,970,366 | 2/1961 | Gill | 492/19 |
| 2,982,010 | 5/1961 | Johns | 492/19 |
| 3,228,087 | 1/1966 | Stoddart et al. | 15/230.11 X |
| 3,430,321 | 3/1969 | Lyons | 492/45 |
| 3,447,184 | 6/1969 | McGinley | 15/230.11 |
| 3,745,624 | 7/1973 | Newman | 492/19 |
| 3,751,748 | 8/1973 | Roe et al. | 15/230.11 |
| 3,774,278 | 11/1973 | Ashton | 492/19 |
| 3,877,123 | 4/1975 | Pharris | 492/19 |
| 3,986,226 | 10/1976 | Roe et al. | 15/230.11 |
| 4,209,883 | 7/1980 | Hawk | 492/19 |
| 4,237,575 | 12/1980 | Mlachnik | 15/230.11 |
| 4,316,301 | 2/1982 | Smith et al. | 15/230.11 |
| 4,332,067 | 6/1982 | Pearce | 492/19 |
| 4,361,923 | 12/1982 | McKay | 15/104.002 |
| 4,402,102 | 9/1983 | Al-samman | 15/230.11 |
| 4,897,893 | 2/1990 | Barker | 15/230.11 |
| 4,937,909 | 7/1990 | Georgiou | 15/230.11 |
| 5,210,899 | 5/1993 | Goldstein et al. | 15/230.11 |
| 5,345,648 | 9/1994 | Graves | 15/230.11 |
| 5,490,303 | 2/1996 | Graves | 15/230.11 |
| 5,594,971 | 1/1997 | Nelson | 15/230.11 |

FOREIGN PATENT DOCUMENTS

| | | | |
|---|---|---|---|
| 1107072 | 12/1955 | France . | |
| 2446136 | 9/1980 | France . | |
| 2558077 | 7/1985 | France . | |
| 851946 | 10/1952 | Germany . | |
| 922693 | 1/1955 | Germany . | |
| 3903519 | 8/1990 | Germany | 15/230.11 |
| 778665 | 7/1957 | United Kingdom . | |

*Primary Examiner*—Mark Spisich
*Attorney, Agent, or Firm*—Foley & Lardner

[57] ABSTRACT

A cage for a roller cover includes a plurality of hubs, a longitudinal support member interconnecting a plurality of hubs and a roller cover support surface integrally formed with the hubs and the support member. The roller cover support surface is resiliently biased outwardly beyond at least one of the hubs for resiliently engaging the roller cover.

16 Claims, 9 Drawing Sheets

FIG. 6
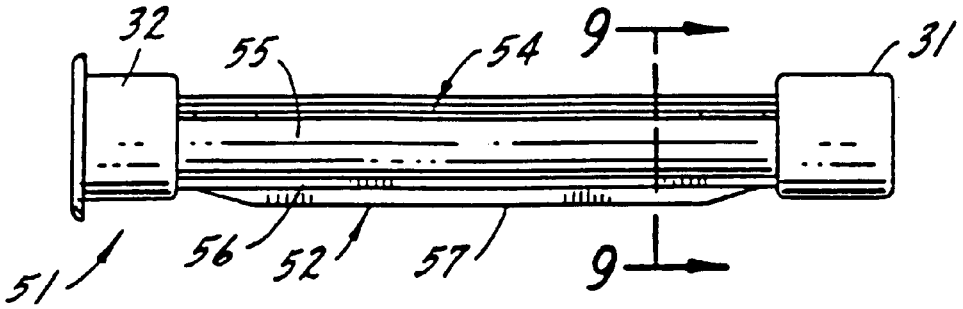
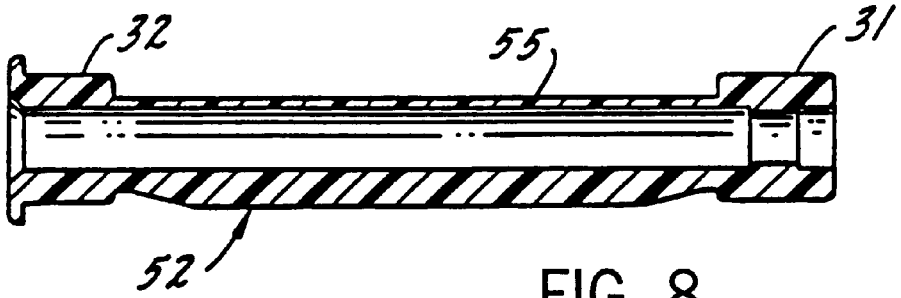
FIG. 8
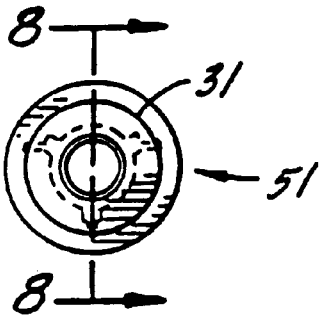
FIG. 7
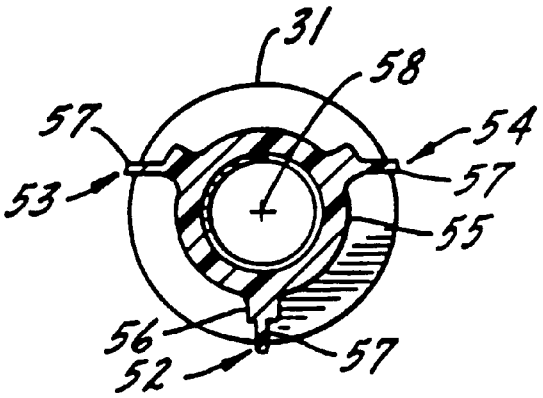
FIG. 9

FIG. 13
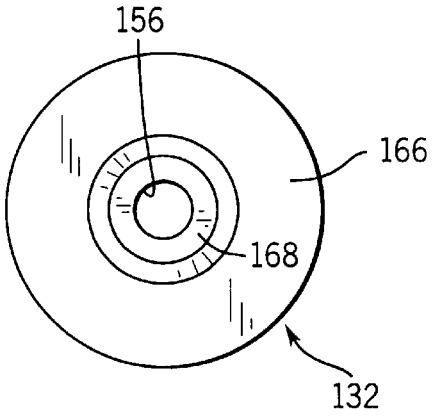
FIG. 17
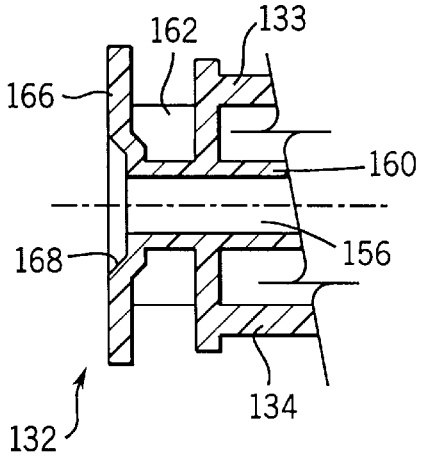
FIG. 14
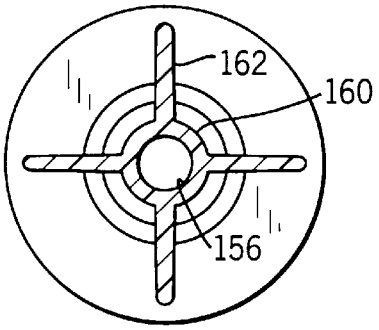
FIG. 15
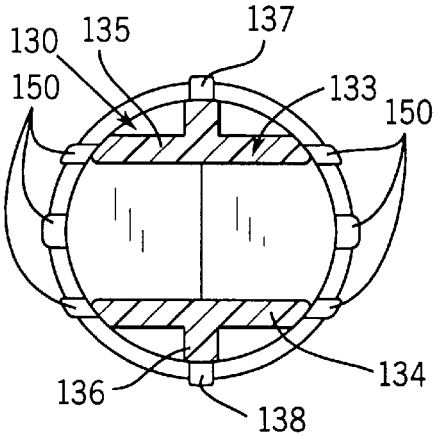
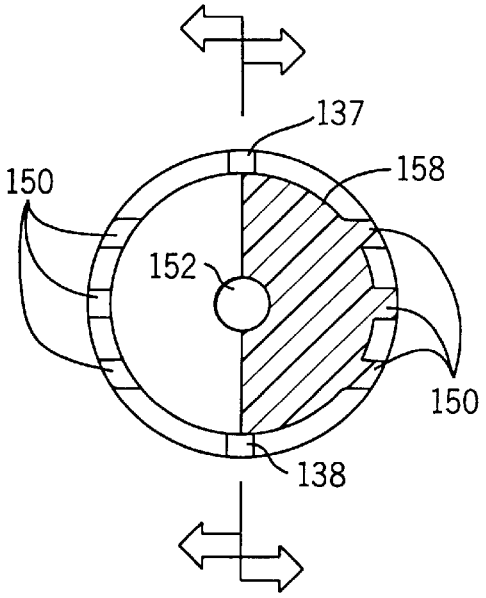
FIG. 16

22
234
25
238
254a
254b
268
244b
244a
237
242b
242a
28
252a
252b
236
240a
240b
250a
250b
235
26
260
24
232
212
262
264

ROLLER HAVING SLIP-ON CAGE FOR PAINT ROLLER COVER

This is a continuation-in-part of application Ser. No. 08/767,580, filed Dec. 16, 1997, which is a continuation-in-part of application Ser. No. 08/383,878, filed Feb. 6, 1995, which issued as U.S. Pat. No. 5,584,092 on Dec. 17, 1996.

FIELD OF THE INVENTION

The present invention relates to a novel roller cage for a liquid coating applicator and, further, to a roller cover which includes said novel roller cage. In particular, the present invention relates to a cage having at least one roller cover support surface integrally formed with the cage and resiliently biased outwardly beyond hubs of the cage to resiliently engage the roller cover.

BACKGROUND OF THE INVENTION

Liquid applicators such as paint rollers have come into very widespread use due to their ability to apply coatings, usually paint, economically and quickly. Nearly every paint roller in commercial use today consists of a frame which terminates at one end in a handle and, at the other end in a cage and cover support rod, a cage received on the support rod, and a roller cover received on the cage. The term "roller" or "roller assembly" when used herein will be used to refer to the just described components, namely (1) a frame having a handle and a support rod, (2) a cage and (3) a roller cover.

The roller and the cage are almost always separable. This is so in order that the cover can be cleaned, or stored, possibly under water until the next use, or thrown away to make room for another cover. Thus, the roller and the cage, at least, are assembleable and disassembleable components which form a sub-assembly of the roller assembly.

The operating requirements of the assembleable/disassembleable cage and roller subassembly of the roller are well defined and, to some extent, at cross purposes. Thus the cage must securely hold the cover during use so that the cover does not "walk off" the cage during use with obviously disastrous consequences, particularly if the cover has just been fully loaded with paint. However, at the same time, the securement between the cover and the cage must not be so tight that separating the roller from the cage at the end of a session's use by the operator (i.e.: for cleaning, storage or discard) is difficult. In addition, nearly all covers consist of an inner tube having a nominally constant bore, which receives the cage, and an outer surface to which the fabric receives and discharges paint. In many cases, due no doubt to the highly competitive nature of this product and thus the inability to provide highly-engineered components which always fit together perfectly, there is a degree of interference between the cover and the cage. The internal diameter of the bore may not be constant for example and thus the cage may have varying degrees of contact with the bore in those areas in which the inside diameter of the bore goes oversize. By the same token the outside diameter of the cage structure may vary due to manufacturing variances, or damage while in use, and hence sections of the cage may make no contact, or only imperfect contact, with the cover so that the convenient removal of the cover from the cage cannot be achieved.

Further, many cages are structurally complex and hence both unduly expensive and unduly susceptible to improper functioning traceable to the complexity of the construction. For example, one widely sold roller includes a first cage element which is assembled to the free end of the support rod, the cage element including a plurality of radial fins which extend inwardly toward the center of the cover only a short distance from the free end, a second cage element which is assembled to the handle end of the cover and also includes a plurality of similar radial fins which extend inwardly from the handle only a short distance, and a third element consisting of a spacer which is located between the two opposed ends of the first and second elements, the only purpose of the spacer being to maintain the first and second elements in fixed, spaced relationship one to the other. The second element which is closest to the handle is often formed with a flange so as to preclude the cover from "walking" toward the handle. The first element cannot have such a flange or there would be no way to assemble the cover to the cage without running the risk of losing cage components, or improperly reassembling the cage. Thus, this common cage construction includes three separate and differently contoured components and substantial assembly costs are incurred in assembling them to the cover both in terms of equipment needed and time required. In addition, should the three cage components come loose from the cover after the sub-assembly of the cover and the cage has been removed from the support rod, the reassembly of the cage components to the roller may be beyond the mechanical skill of many consumers-users. First, for example, should the spacer be lost and the cover with the two end elements reassembled to the support rod without it, subsequent failure is likely to occur because there is nothing to maintain the end elements in proper spaced relationship. Second, for example, the outer core element may creep inwardly during use causing paint to build up in the space at the end of the tube which has been vacated by the first cage element. Should the user carelessly or intentionally permit the deposited paint to harden prior to the next use, the removal of the cover, as when it is worn, or to install a different cover with a different fabric nap to do a different painting task, may be nearly impossible for the average consumer-user.

A further shortcoming of most commercially available rollers is the high molding costs and the high assembly costs associated with fitting the cage and cover to the support rod using the current attachment methods such as crimps, washers, push nuts and other multi-piece attachment mechanism.

SUMMARY OF THE INVENTION

The unique roller cage of this invention consists of a one-piece cage which can be quickly and simply snapped onto the cage and cover support rod of a roller handle whereby the cage is prevented from separating longitudinally from the handle, and onto which a cover may be easily assembled and easily disassembled, with the cover held tightly during use. Further, the cage is so constructed that it automatically adjusts to dimensional variations in the bore of the tube of the cover so that a gripping force exists between the cage and the tube at all locations without regard to dimensional variations which may exist in either or both of the cage and the tube. In addition, the cage is of one piece construction so that it can be economically molded and assembled to the support rod of the handle at a very low cost.

The invention further consists of the combination of a handle and the roller cage as above described, the handle being constructed to receive the cage by a push-nut which, as mentioned, precludes longitudinal displacement of the cage and its associated cover from the handle during use, yet which permits easy disassembly of the cage and cover sub-assembly when a cover change is required.

The foregoing is preferably achieved by forming the cage as a one-piece plastic or thermal plastic rubber member. A plurality of projections formed on the exterior of the cage are deformed by the tube as the cover is attached to the cage in a direction to exert a resisting force to the separation of the cover from the cage under normal working stresses. The projections may be either a plurality of rings or teeth arranged in a generally radial pattern, or the projections may be arranged in a generally longitudinally pattern with respect to the axis of the cage. The projections are preferably constructed to be deformed at their extremities whereby they come into contact with the tube of the cover so as to generate a frictional resisting force to the separation of the cover from the cage during use. In a first and second embodiment of the invention, the projections are formed as surface extensions of a tubular barrel, and in a third embodiment, the projections are formed as extensions of structural components of an open structure comprised of hubs joined by a longitudinal support beam.

In another embodiment of the invention, the cage includes a plurality of hubs, a longitudinal support member interconnecting the plurality of hubs and a roller cover support surface integrally formed with the hubs and the support member. The roller cover support surface is resiliently biased outwardly beyond at least one of the hubs for resiliently engaging the roller cover.

BRIEF DESCRIPTION OF THE DRAWINGS

FIG. 6 is a plan view of a second embodiment of cage of the present invention usable with the handle shown in FIG. 1.

FIG. 7 is a right-end view of the cage shown on FIG. 6.

FIG. 8 is a longitudinal section taken substantially along the line 8—8 of FIG. 7.

FIG. 9 is a section taken substantially along the line 9—9 of FIG. 6 to an enlarged scale.

FIG. 13 is an end view of the cage as shown in FIG. 10.

FIG. 14 is a transverse section taken along lines XIV—XIV of FIG. 10.

FIG. 15 is a transverse section taken along lines XV—XV of FIG. 10.

FIG. 16 is a transverse section taken along lines XVI—XVI of FIG. 10.

FIG. 17 is a partial longitudinal section taken along lines XVII—XVII of FIG. 13.

DETAILED DESCRIPTION OF THE PREFERRED EMBODIMENTS

Figures 1, 2, 3, 4, 5:
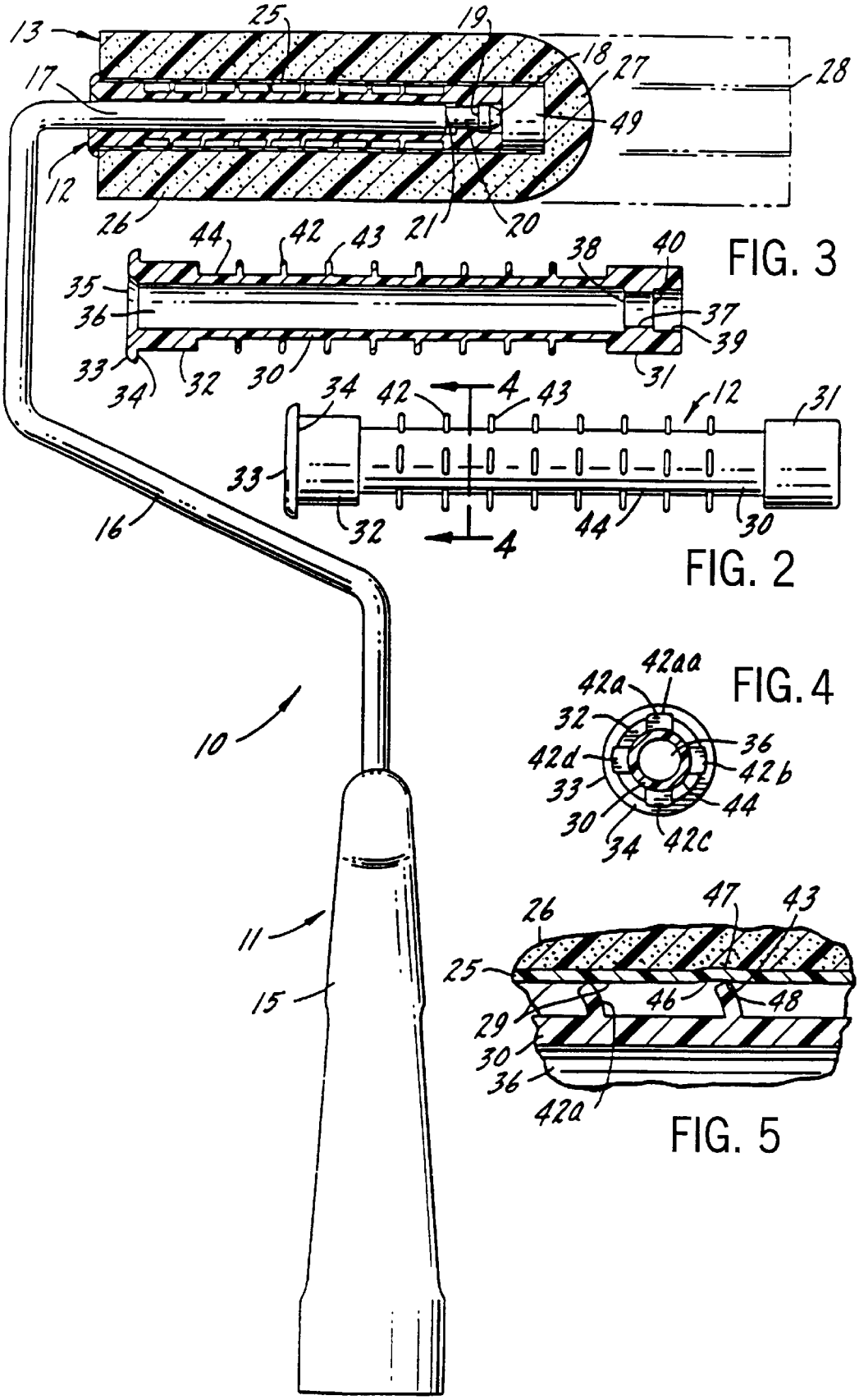
FIG. 1 is a plan view with parts in section of a paint roller having the first embodiment of the present invention, the roller being contoured to be assembled in cooperating relationship with the cage.
FIG. 2 is a plan view of the cage of the invention to an enlarged scale as contrasted to FIG. 1.
FIG. 3 is a longitudinal section view of the cage.
FIG. 4 is a section view taken substantially along the line 4—4 of FIG. 2.
FIG. 5 is a partial, detail view showing the cooperative relationship between the projections on the cage and the tube of the cover to yet a further enlarged scale as shown in FIG. 1.
Figure 10:
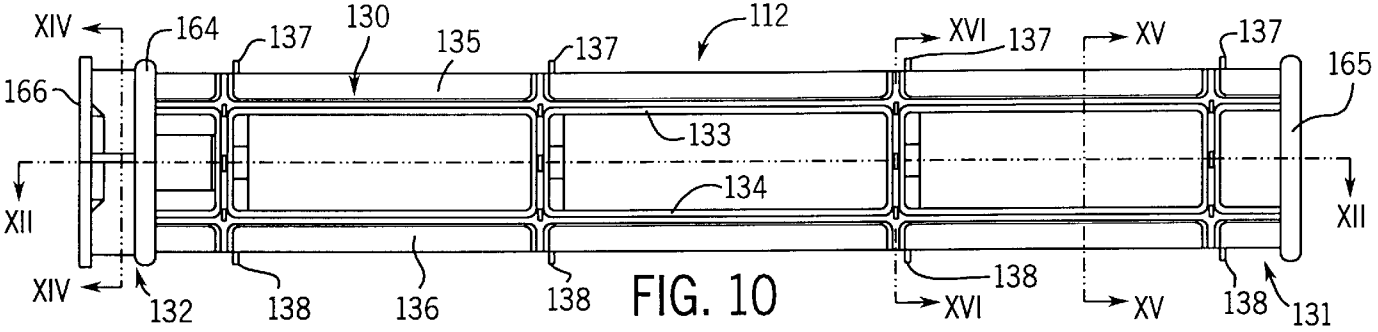
FIG. 10 is a side elevational view of a second embodiment of a cage of the present invention.
Figure 11:
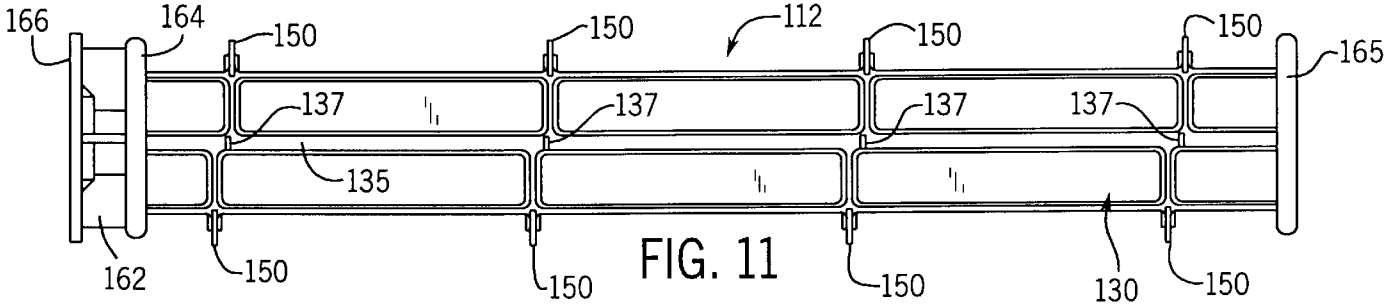
FIG. 11 is a plan view of the cage shown in FIG. 10.
Figure 12:
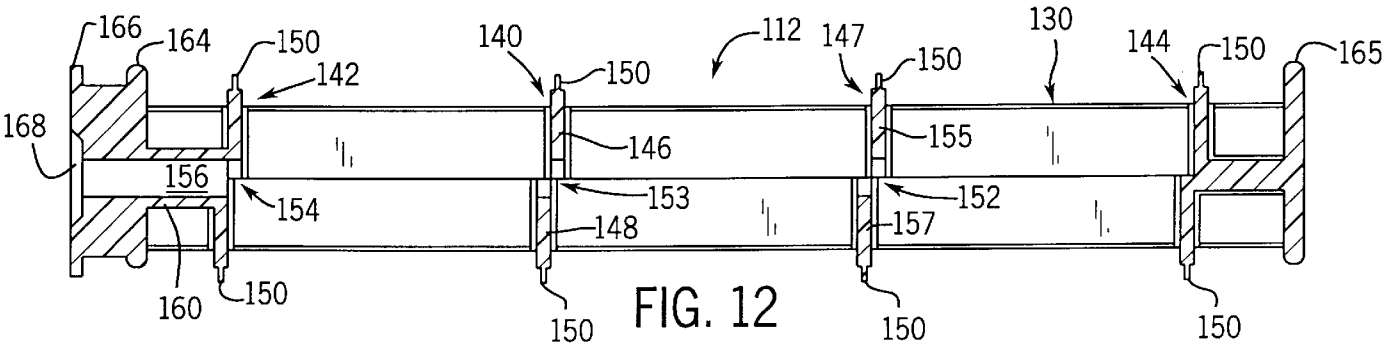
FIG. 12 is a longitudinal section of the cage shown in FIG. 10 taken along lines XII—XII in FIG. 10.

Like reference numerals will be used to refer to like or similar parts from Figure to Figure throughout the following descriptions of each of the embodiments of the invention shown in the drawings.

Referring first to FIG. 1 a roller is indicated generally at 10. The roller consists in this instance of three main components, a handle, indicated generally at 11, a roller cage, indicated generally at 12 and a cover, indicated generally at 13.

The handle 11 includes a hand grip 15, an extension section 16 which has an offset configuration, and a cage and roller support rod 17. The extremity of the support rod 17 is formed in a bullet shape 18 which terminates at its rear in a shoulder 19. A necked-down portion forms a collar ring 20, the collar ring 20 being a smaller diameter than the diameter of the support rod 17 so that a shoulder is formed at 21.

The cover 13 consists essentially of an inner tube 25 which is preferably formed from a suitable plastic such as polypropylene. Other flexible materials include polyethylene, nylon and thermal plastic rubber. The inside diameter of the tube is nominally constant from end to end of the tube but it will be understood that, in view of the materials and mass production methods used in manufacture, the inside diameter may vary slightly from location to location as will be amplified hereinafter. A cover is indicated at 26, the cover being secured to and surrounding tube 25. In this instance a foam cover having a continuous, closed end 27 is shown. It will be appreciated however that a conventional pile fabric cover, which is open at the ends as indicated at 28 in the dotted line extension of the right end of the cover 26, may equally as well be used.

The cage 12 is illustrated in assembled condition with a handle 11 and cover 13 to form a complete roller in FIG. 1. However, the features of the cage can be best appreciated from the showings in FIGS. 2–5 which are shown to a larger scale than FIG. 1.

The cage 12 includes a barrel portion 30 which terminates at its right, or outer, end in an enlargement 31 and at its left, or inner, end in another enlargement 32. The left end of enlargement 32 terminates in a flange 33 having an outwardly facing flange shoulder 34. It will be noted that the outside diameter of enlargement portions 31 and 32 are of equal diameter and of a size to be snugly received within tube 25. The flange 33 however extends outwardly beyond the outside diameter of tube 25 so that the left end of tube 25 butts against flange shoulder 34 in the assembled condition of FIG. 1.

A constant diameter bore 36 extends from the chamfered end of the barrel to, in this instance, a location just within the enlargement 31. The diameter of the bore is sufficient to freely receive the support rod 17 without binding, yet without appreciable looseness, so the cage and cover sub-assembly are able to rotate about the support 17 which is non-rotatable. The right end of the bore 36 opens into a necked down portion 37 of reduced diameter, the left end of necked down portion 37 forming an abutment shoulder 38 which extends radially inwardly a distance sufficient to engage collar ring shoulder 21 of rod 17 should the cage and cover sub-assembly move to the left with respect to the support rod 17. The outer end of the necked down portion 37 opens into an end bore 39 having a diameter larger than the diameter of the bore in necked down portion 37, thereby forming an annular shoulder 40. It will be understood that since the diameter of the base of the bullet nose 18 of rod 17 is larger than the diameter of the bore in necked down portion 37, rod shoulder 19 will butt against annular shoulder 40 when the cage and cover sub-assembly move to the right with respect to rod 17; see the FIG. 1 position.

A plurality of projections 42, 43 extend generally radially outwardly from the outside surface 44 of barrel 30. In this instance the projections are arranged in rows lying in vertical planes passing through the axis of the cage, and, further, there are 4 projections per row as indicated at 42*a*, 42*b*, 43*c* and 42*d* in FIG. 4. As can be best seen in FIG. 4, the outer curved edges, one of which is seen at 42*aa*, when in a relaxed, disassembled condition, project outwardly from barrel 30 a distance slightly greater than the outside surface of enlargement 32, as best seen in FIG. 4, and hence outwardly a radial distance slightly greater than the inside diameter radius of tube 25.

When the cage is assembled to a cover as shown in FIGS. 1 and 5 the relationship between the projections 42, 43, the barrel 30, and tube 25 are altered. Referring primarily to FIG. 5 it will be noted that when a projection, such as 42*a*, is located opposite a section of the tube 25 which has a constant diameter, as at 29, the projection or fin 42*a* is bent to the left so that pressure is exerted between the projection 42*a* and the tube 25 which results in frictional resistance against movement in either direction of tube 25 with respect to projection 42*a*, but more so with respect to movement of tube 25 to the right with respect to barrel 30 and projection 42*a*.

As mentioned, the bore of the tube 25, though intended to be of constant internal diameter, is not always constant from location to location due to various factors including manufacturing tolerances, etc. In the area indicated at 46 it will be seen that a slight outward bulge 47 appears in tube 25 resulting in an increase in the inside diameter of the tube 25 at that location, and the bulge is formed at the precise location where projection 43 makes contact with the inside surface 48 of tube 25. In this instance, the projection 43 still makes contact with surface 48 since the depth of the bulge does not extend outwardly beyond the relaxed extreme outer edge, represented at 42*aa*, or projection 43. The projection 43, while making contact with the tube 25, is under less deflection tension than projection 42*a*, and hence a lower frictional resistance exists between projection 43 and tube 25 than exists projection 42*a* and tube 25. Thus, even though the contour of the bore in tube 25 varies from location to location along its length, the projections on the barrel portion of the cage adapt themselves to such variations so that some pressure, and hence frictional resistance to longitudinal separation, exists at all contact points between the projections and the tube 25.

It will be noted that in the solid line position of FIG. 1 a plug 49 is anchored in the outer end of tube 25 as by friction or sonic welding. In the dotted line position of FIG. 1 the closed end portion 27 of the cover has been eliminated. This construction will be particularly advantageous in connection with use of a conventional fabric cover which does not include a closed end.

Referring now to FIGS. 6 through 9 it will be noted that cage 51 is longitudinal projections 52, 53, 54 instead of vertical or lateral projections 42, 43.

Cage 51 includes a barrel portion 55 which terminates at its outer end in enlargement 31 and at its inner end in enlargement 32. From FIG. 9 it will be noted that each of longitudinal projections 52, 53 and 54 includes a base portion 56 and a fin 57 extending outwardly from an associated base 56. The fin 57 extends radially outwardly to a point which is located a greater radial distance from the axis 58 than the surface of enlargement 31, and hence the inside surface of tube 25, all as best seen in FIG. 9. The fins 57 are sufficiently thin and flexible to be bent over as a tube 25 is fitted over cage 51, the ends of the bent over or deflected portions 57 of longitudinal projections 52, 53 and 54 thereby making pressure contact with the inside surface of the tube 25. As before, the pressure exerted between the fins 57 of longitudinal projections 52, 53, 54 and the tube 25 will create a substantial frictional resistance to relative movement between the cage and tube, and hence the tube and cover will not walk off the cage. It will also be noted that the fins or tips 57 of the projections 52–54 are sufficiently thin and flexible that contact will be made at all locations between the tube and fins, the fins 57 being deformed to a greater or lesser extent from location to location along the cage to accommodate variations in the contour of the inside of the tube.

FIGS. 10 through 17 show a third embodiment of the cage of the present invention. This embodiment is believed to be particularly well-suited for application of the invention to larger rollers, such as those used to apply paint over large areas.

FIGS. 10 through 13 show the longitudinal profile of a cage 112. A proximal hub 132 at one end of the cage 112 is jointed to a distal hub 131 at the other end by a longitudinal support beam 130. (See also FIG. 15, which shows the beam 130 in cross-section.) The term proximal and distal are used to describe the hubs 132 and 131, respectively, because the proximal hub 132 is nearer to the supporting portion of a roller handle, and the distal hub 131 is farther from the supporting portion of a roller handle. The beam 130 acts to provide the cage 112 with structural integrity much in the way that the inner tube 25 of the embodiment of FIGS. 1 through 5 and the barrel portions 55 is FIGS. 6 through 9 act as beams and possible structural support for the cage in the first and second embodiments.

The beam 130 is comprised of two chord-like flat sections 133 and 134 which have longitudinal ribs 135 and 136, which add to the stiffness of the flat sections from which they extend. Four projections 137 extend radially outwardly from the rib 135, and four projections 138 extend diametrically opposingly from the rib 136.

Spaced along the length of the cage 112 are four inner intermediate hubs, one proximal intermediate hub 142, one distal intermediate hub 144, and two inner intermediate hubs 140 and 147. The configuration of the intermediate hubs is best understood by a consideration of FIGS. 12 and 16. Each of the intermediate hubs 140, 142, 144 and 147 has six projections 150, three extending in one direction and three others extending in an opposing direction.

The inner intermediate hubs 140 and 147 are comprised of two axially offset half-hubs; the inner intermediate half-hub 140 is made up of two half-hubs 146 and 148, each of which defines half of the aperture 153. The other inner intermediate half-hub 147 is comprised of two half-hubs 155 and 157 which are axially offset and which define an aperture 152. Similarly, the proximal intermediate hub 142 has an aperture 154. The aperture 156 in the proximal hub 132 and the apertures 152, 153 and 154 are all concentric and are generally sized so as to receive a rod, and to allow rotation of the cage 112 freely about the rod of the type shown in FIG. 1, while retaining the cage 112 on the rod.

Retention of the cage 112 by a rod is accomplished by placement of a push-nut (not shown) on the end of a smooth rod, i.e. a rod which does not have a collar ring or the shoulders as shown in the rod of FIG. 1. Access to the smooth end of the rod, for purposes of installing a push-nut, is provided by the space between the two chord-like flat sections 133 and 134 which make up the beam 130.

The cage 112 is equipped with four rings of projections, each ring having eight projections. The pattern is best seen in FIGS. 15 and 16. Each ring of projections includes an upper projection 137, a lower projection 138, and six lateral projections 150. Each projection cooperates with the wall of a tubular roller in a manner as shown in FIG. 5, whereby the projection is deflected by the insertion of the cage 112 into a tubular roller. The flexibility of the projections is such that installation of the roller on a cage results in a tilting of the projection and a slight local deformation of the wall of the tubular roller. While the cage 112 has four rings of eight projections in each ring for a total of thirty-two projections, persons of skill in the art of plastic injection molding and/or roller design may vary the number of projections, the number of rings of projections, and the size and stiffness of the projections and the properties of the tubular roller to accomplish good retention performance without sacrificing resistance to "walk-off" and without sacrificing ease of removal of the roller for cleaning.

FIG. 16 shows the configuration of the intermediate hub 147 and its half-hubs 155 and 157. The half-hub 155 is comprised of an inner portion which defines half of the semi-cylindrical aperture 152 and a web 158 from which extend the projections 150. It should be noted that the center one of the three projections 150, which are formed on the web 158, extends generally radially from the central axis of the cage 112, and the other two of those three projections 150 are generally parallel to the center one. This is to allow removal of the cage 112 from a two plate injection mold.

FIG. 14 is a transverse section through a portion of the proximal hub 132. Spokes 162 extend radially from the sleeve 160 around the passageway 156. The spokes 162, together with the sleeve 160, connect the first inner flange 164 to the outer flange 166.

The distal hub 131 also has a flange 165, similar in dimension to the flange 164. The flanges 164 and 165 are shaped to provide some sealing effect against the inside diameter of a tubular roller, so as to limit, or preferably prevent, the ingress of liquid into the inner portions of the cage 112 once the cage 112 is installed within a tubular roller. The larger diameter flange 166 acts as a stop against which an end of the tubular roller abuts when the roller is fully installed onto the cage 112.

FIGS. 13 and 17 are end and sectional views, respectively, of the proximal hub 132 and show the configuration of the elements which make up the proximal hub 132. A recess 168 forms the flange 166 at the proximal end of the passageway 156. At the opposite end of the cage 112, the outer face of the flange 165 is preferably smooth. The distance from the inside edge of the flange 166 and the outer face of the flange 165 is preferably about the same as the length of a roller carried by the cage so that when a tubular roller is placed onto the cage 112, the distal end of the roller is flush with the outside face of the flange 165.

Figure 18:
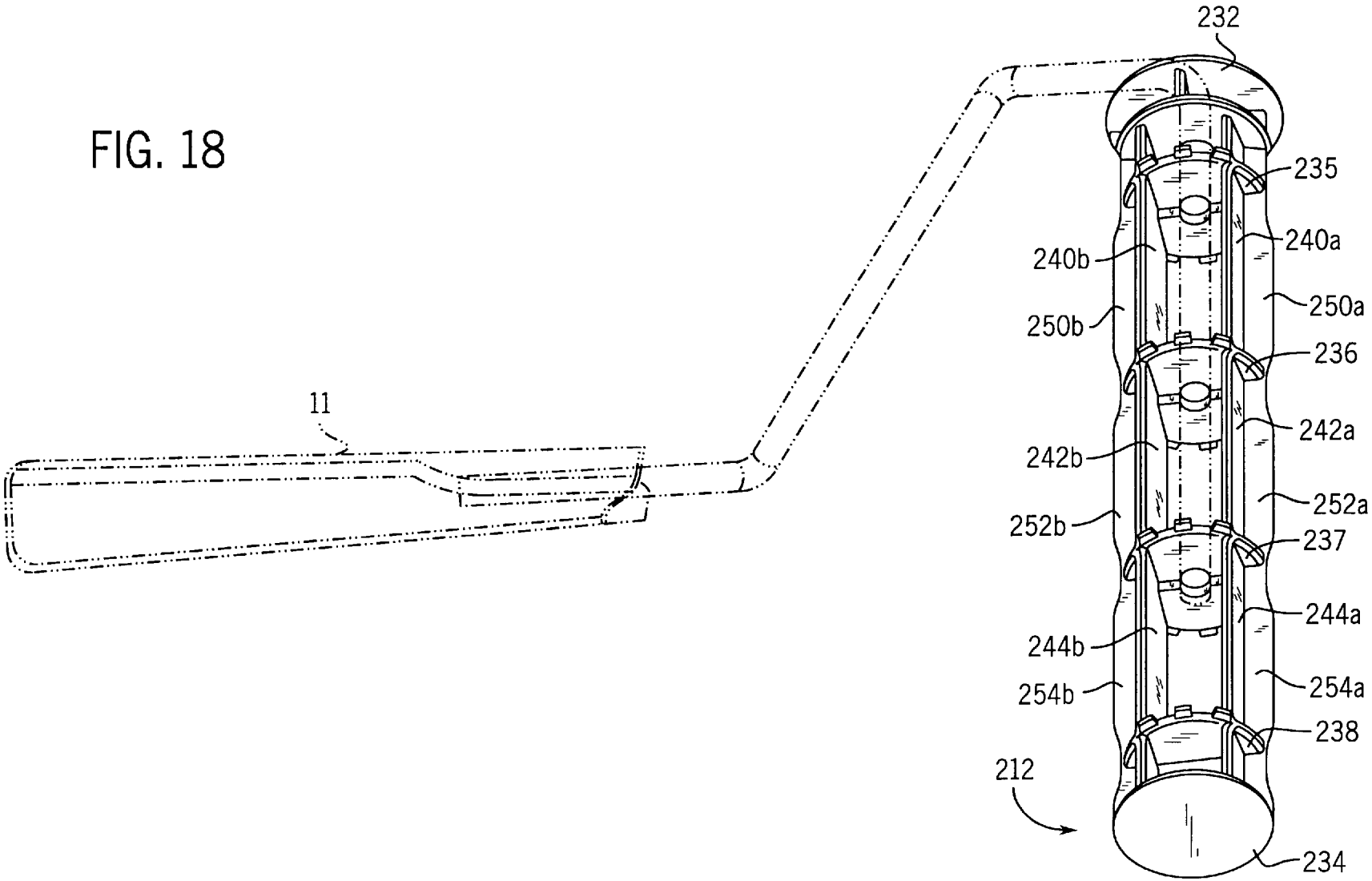
FIG. 18 is a perspective view of a fourth embodiment of the cage of the present invention supported by a roller frame handle.
Figure 19:
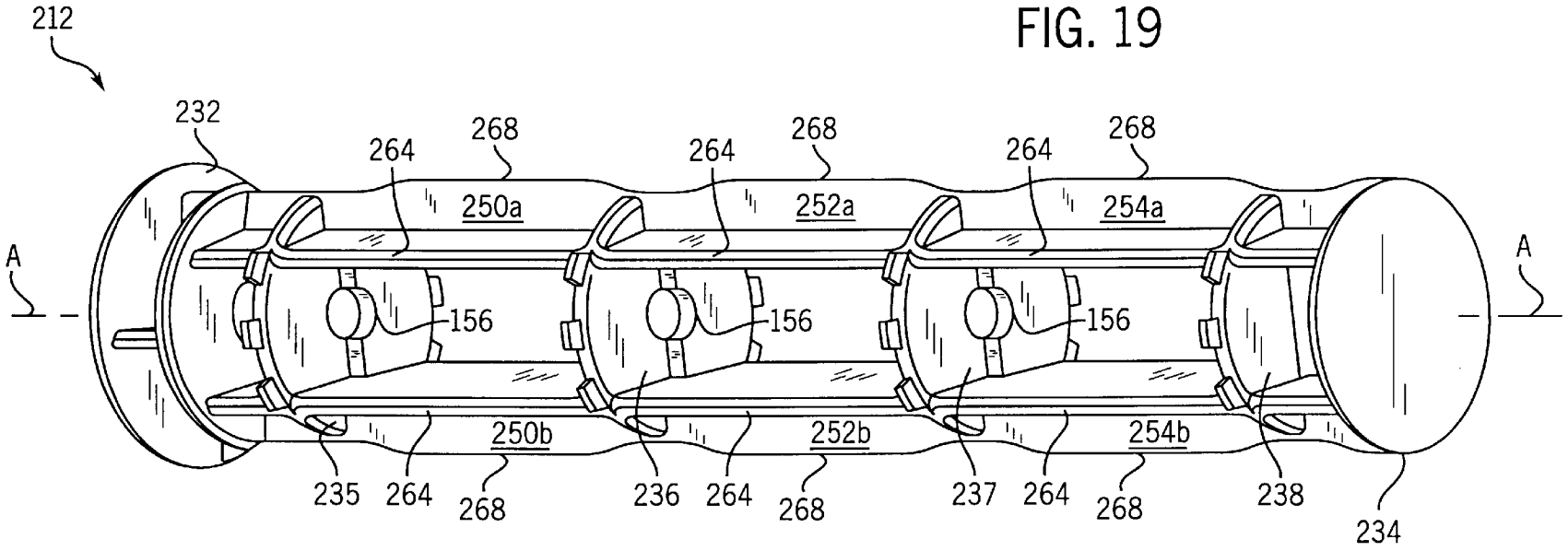
FIG. 19 is an enlarged perspective view of the cage of FIG. 18.
Figures 20, 21, 22:
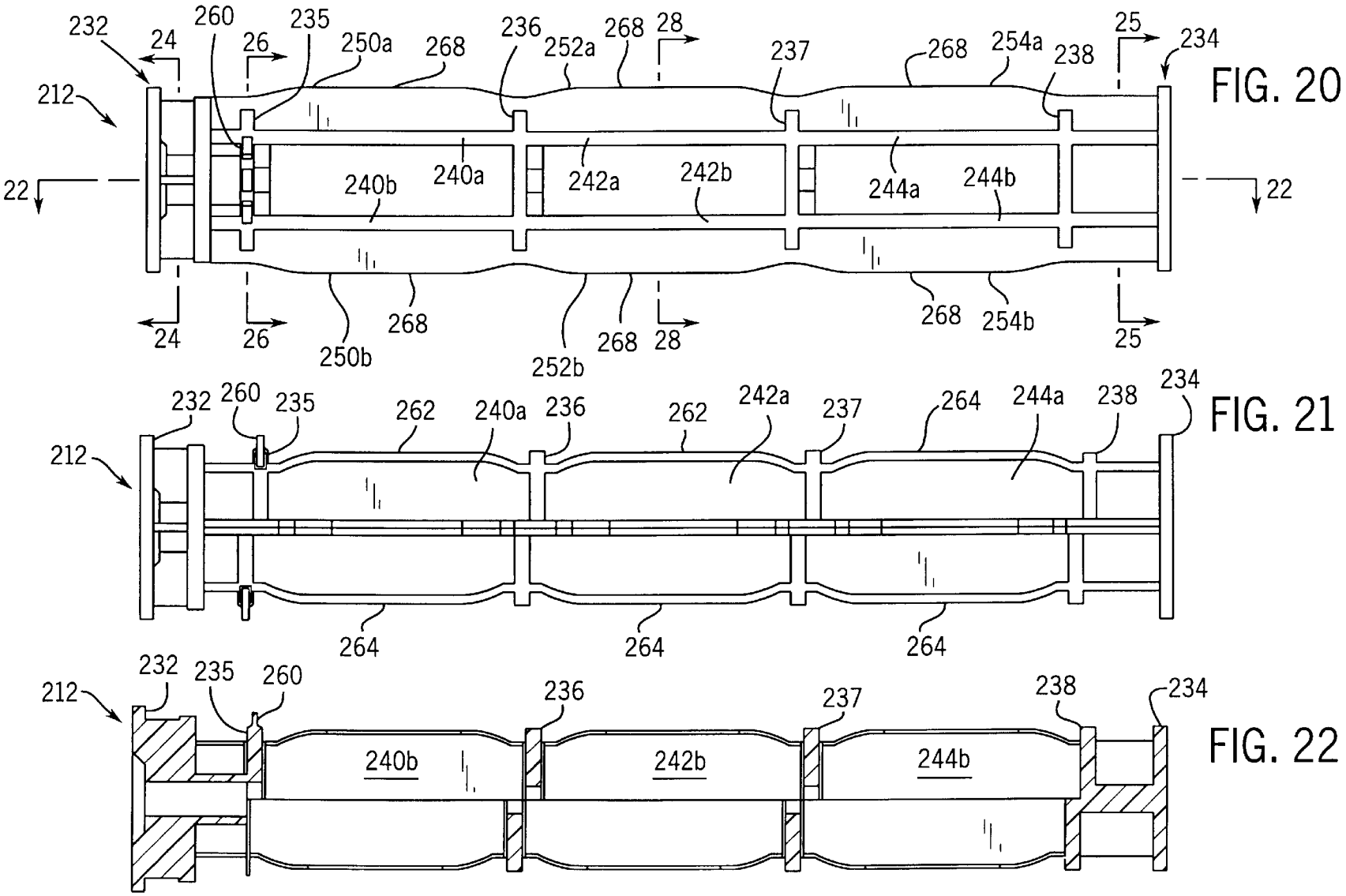
FIG. 20 is side elevational view of the cage of FIG. 19.
FIG. 21 is a top plan view of the cage of FIG. 19.
FIG. 22 is a longitudinal sectional view of the cage taken along lines 22—22 of FIG. 19.
Figure 23:
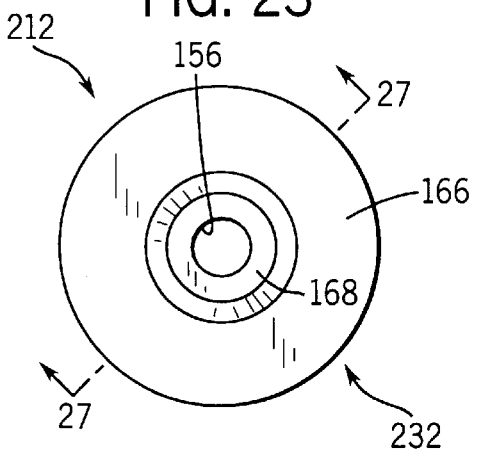
FIG. 23 is an end view of the cage of FIG. 20.
Figure 24:
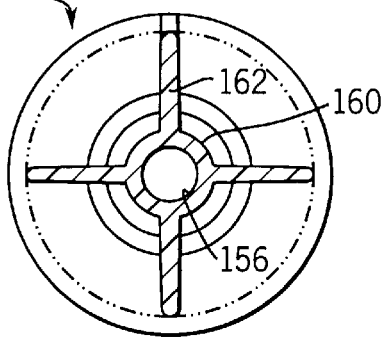
FIG. 24 is a transverse sectional view of the cage taken along lines 24—24 of FIG. 20.
Figure 25:
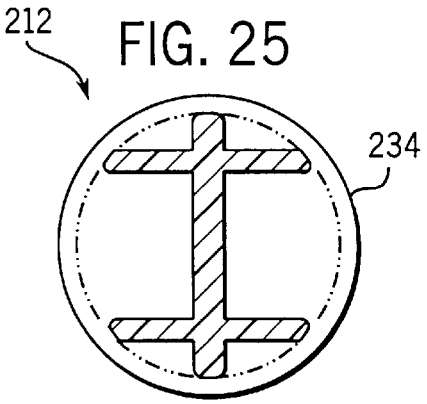
FIG. 25 is a transverse sectional view taken along lines 25—25 of FIG. 20.
Figure 26:
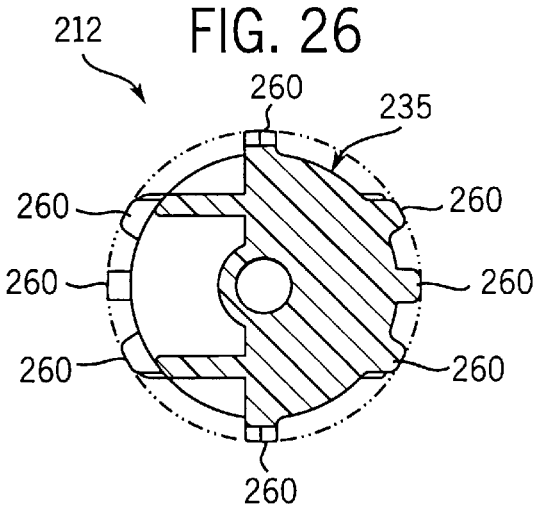
FIG. 26 is a transverse sectional view taken along lines 26—26 of FIG. 20.
Figure 27:
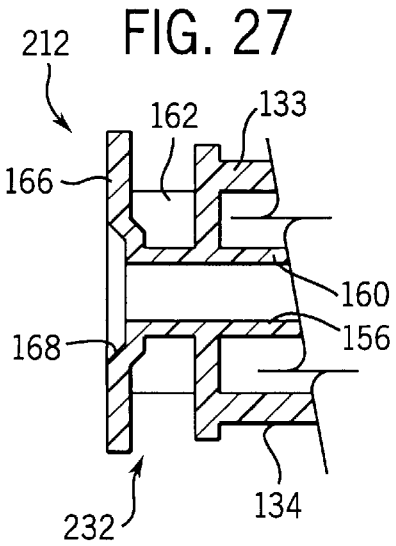
FIG. 27 is a partial longitudinal sectional view taken along lines 27—27 of FIG. 22.

FIGS. 18–29 illustrate cage 212, a fourth embodiment of cage 12 shown in FIGS. 1 through 5. FIG. 18 is a perspective view illustrating cage 212 rotatably supported by handle 11 and configured for rotatably supporting a roller cover 13 (shown in FIG. 29). FIG. 19 is an enlarged perspective view illustrating cage 212 in greater detail. FIGS. 20 through 22 show the longitudinal profile of cage 212. Cage 212 is preferably integrally molded to have a unitary construction. In the preferred embodiment illustrated, cage 212 is preferably molded from low density polyethylene. Because cage 212 is integrally molded, cage 212 is simpler to manufacture and assemble as part of roller frame handle 11.

Cage 212 generally includes proximal hub 232, distal hub 234, intermediate hubs 235, 236, 237 and 238, bridge members 240*a*, 240*b*, 242*a*, 242*b*, 244*a*, 244*b*, longitudinal support members 250*a*, 250*b*, 252*a*, 252*b*, 254*a*, 254*b*, and projections 260. Proximal hub 232, distal hub 234 and intermediate hubs 235, 236, 237, and 238 are centered about an Axis A and are substantially identical to proximal hub 132, distal hub 131 and intermediate hubs 142, 140, 147, and 144, respectively.

Bridge members 240*a*, 240*b*, 242*a*, 242*b*, 244*a* and 244*b* interconnect and span hubs 235, 236, 237 and 238. In particular, bridge members 240*a* and 240*b* interconnect and span hubs 235 and 236 along Axis A. Bridge members 242*a*, 242*b* interconnect and span hub members 236 and 237 along Axis A. Bridge members 244*a*, 244*b* interconnect and span hubs 237 and 238 along Axis A. Each set of bridge members 240*a*, 240*b*, 242*a*, 242*b*, and 244*a*, 244*b* preferably extend opposite one another on opposite sides of Axis A. Each bridge member 240, 242, and 244 includes a pair of opposite roller cover support edges 262, 264. Roller cover support edges 262, 264 longitudinally extend along Axis A at a distance spaced from Axis so as to frictionally engage and support an inner surface of roller cover 13. Support edges 262, 264 of each bridge 240, 242, 244 are preferably radially fixed and generally inflexible. Support edges 262 and 264 are radially spaced from Axis at a distance substantially equal to or slightly less than the inner circumference of roller cover 13. In other words, support edges 262, 264 are preferably radially spaced from Axis by a distance equal to the radius of distal hub 234.

Bridge members 240*a*, 240*b*, 242*a*, 242*b*, and 244*a*, 244*b* resiliently support and bias longitudinal support members 250*a*, 250*b*, 252*a*, 252*b*, and 254*a*, 254*b*, respectively. Bridge members 240, 242, and 244 are preferably dimensioned and made from an appropriate material so as to resiliently deform or flex between adjacent hubs. In the preferred embodiments illustrated, bridge members 240, 242 and 244 are preferably made from a low density polyethylene and have a thickness of approximately 0.125 inches.

Figure 28:
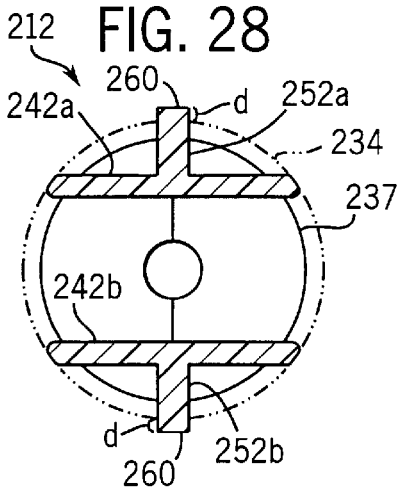
FIG. 28 is a transverse sectional view taken along lines 28—28 of FIG. 20.
Figure 29:
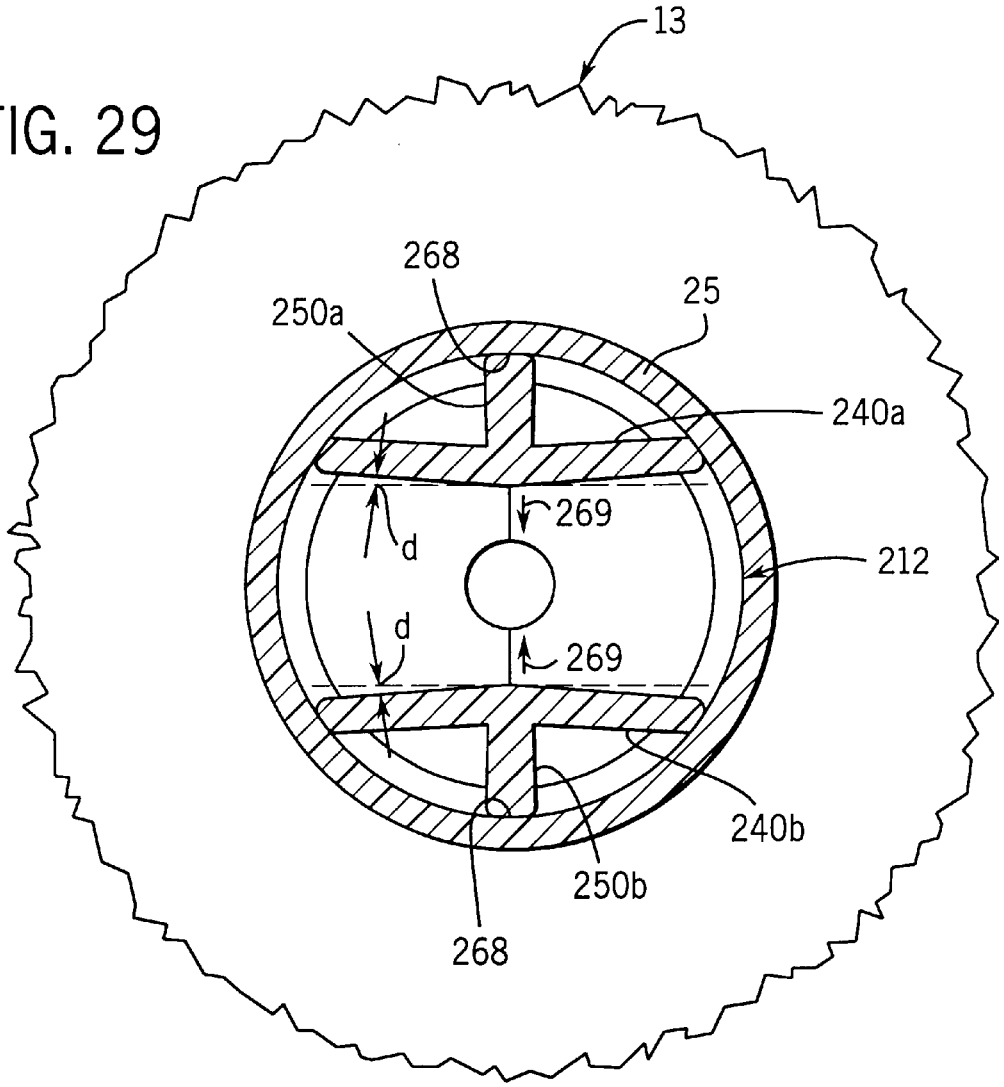
FIG. 29 is a sectional view of the cage of FIG. 18 supporting a roller cover.

Longitudinal support members 250*a*, 250*b*, 252*a*, 252*b*, and 254*a*, 254*b* obliquely extend from and along corresponding bridge members 240*a,* 240*b,* 242*a,* 242*b,* and 244*a,* 244*b* away from Axis A. Longitudinal support members 250*a,* 250*b,* 252*a,* 252*b,* and 254*a,* 254*b* each define a longitudinally extending roller cover support surface 268. Each roller cover support surface 268 is defined at an outer most extremity of its longitudinal support member and is configured for frictionally engaging an inner surface of tube 25 of roller cover 13. As shown in FIG. 28, roller cover support surfaces 268 are resiliently biased outwardly beyond distal hub 234 and beyond inner circumferential surface of cover 13 by bridge members 240, 242 and 244. As a result, as shown by FIG. 29, upon insertion of cage 212 within roller cover 13, bridge members 240, 242 and 244 resiliently bend or inwardly deflect towards Axis A as indicated by arrows 269 by a distance d to enable longitudinal support members 250, 252, and 254 be received within roller cover 13. To further enable bridge members 240, 242, and 244 to inwardly deform or pivot with respect to adjacent hubs, each longitudinal support member 250, 252, 254 has a reduced height at each adjacent hub.

As best shown by FIG. 29, bridge members 240, 242 and 244 resiliently bias roller cover support surfaces 268 outwardly against the inner circumferential surface of roller cover 13. At the same time, roller cover support edges 262, 264 of each bridge member 240, 242, and 244 rigidly engage the inner circumferential surface of roller cover 13 to maintain the circular cross-sectional shape of roller cover 13. As a result, bridge members 240, 242, and 244 urge or spring load roller cover support surfaces 268 against the generally immovable inner circumferential surface of roller cover 13 to increase the frictional resistance between roller cover support surfaces 268 and the inner circumferential surface of roller cover 13. This increased resistance securely retains roller cover 13 about cage 212 to prevent undesirable movement of roller cover 13 relative to cage 12 during the application of liquids, such as paint, to surfaces.

Projections 260 further assist in retaining roller cover 13 about cage 212. Projections 260 are substantially identical to projections 137, 138 and 150 of cage 112. In particular, each projection 260 provides a transversely extending roller cover support surface. Each projection 260 is sufficiently thin and flexible to resiliently bend in a longitudinal direction upon being inserted into roller cover 13. The pressure exerted between projections 260 and tube 25 of roller cover 13 creates substantial friction or resistance to relative movement between cage 212 and tube 25.

In the preferred embodiment illustrated, tube 25 of roller cover 13 has an nominal inner radius of about 0.742 inches. Roller cover support edges 262, 264 also are spaced from Axis A by a nominal radial distance of about 0.742 inches. Roller cover support surfaces 268 are radially spaced from Axis A by a nominal distance of about 0.755 inches. Projections 260 nominally project up to 0.765 inches away from Axis A. Proximal hub 232 preferably has a maximum nominal outer radius of about 0.80 inches. Distal hub 234 preferably has a nominal outer radius of about 0.725 inches. Intermediate hubs 235, 236, 237, and 238 have nominal outer radiuses of about 0.65 inches.

It will be understood that embodiments shown herein are examples of the invention, and that numerous variations and modifications of the invention may be made without departing from the spirit and scope of the invention. Accordingly, the scope of the invention should not be judged by the foregoing descriptions but instead by the scope of the appended claims as interpreted in accordance with applicable law.

We claim:

1. A cage for a roller cover, the cage comprising:

a plurality of hubs including a distal hub centered about an axis and a proximal hub centered about the axis; and at least three circumferentially spaced longitudinally extending roller cover support surfaces integrally formed with the hubs and extending outwardly beyond at least one of the hubs, a first and a second of the roller cover support surfaces extending in a plane spaced from said axis and the third roller cover support surface further extending from the plane intermediate the first and second roller cover support surfaces, wherein the third roller cover support surface is resiliently biased outwardly beyond the at least one of the hubs for resiliently engaging the roller cover.

2. The cage of claim 1 wherein the third roller cover support surface radially flexes.

3. The cage of claim 2 including:

a longitudinal bridge extending between adjacent hubs and supporting the flexing surface, wherein the bridge flexes to radially flex the flexing surface.

4. The cage of claim 3 wherein the longitudinal bridge has first and second opposite edges providing the first and the second roller cover supporting surfaces, respectively.

5. The cage of claim 1 including at least one transversely extending roller cover support surface resiliently biased beyond at least one of the hubs to longitudinally flex when engaging the roller cover.

6. The cage of claim 1 wherein said at least one of said roller cover support surfaces extend along a projection extending from at least one of the plurality of hubs.

7. The cage of claim 1 wherein the third roller cover support surface has a reduced height adjacent at least one of the plurality of hubs.

8. The cage of claim 1 wherein at least one of the roller cover support surfaces is inflexible in a radial direction.

9. A cage for a roller cover, the cage comprising:

first and second hubs centered about an axis;

a first bridge spanning the first and second hubs along the axis, the first bridge being resiliently deformable towards the axis, wherein the first bridge has first and second opposite edges providing first and second roller cover supporting surfaces configured to engage the roller cover; and a first longitudinal support member longitudinally extending along the first bridge non-parallel from the first bridge to provide a third roller cover support surface beyond at least one of the first and second hubs, wherein the first bridge resiliently biases the third roller cover support surface into engagement with the roller cover.

10. The cage of claim 9 including:

a second bridge spanning the first and second hubs, the second bridge being resiliently deformable towards the axis, wherein the second bridge has third and fourth opposite edges providing fourth and fifth roller cover supporting surfaces configured to engage the roller cover; and a second longitudinal support member extending along the second bridge non-parallel from the second bridge to provide a sixth roller cover support surface beyond at least one of the first and second hubs, wherein the second bridge resiliently biases the sixth roller cover support surface into engagement with the roller cover.

11. The cage of claim 10 wherein the second bridge extends diametrically opposite the first bridge and wherein the sixth roller cover support surface extends diametrically opposite the third roller cover support surface.

12. The cage of claim 9 wherein the third roller cover support surface has a reduced height adjacent the first hub.

13. The cage of claim 12 wherein the third roller cover support surface has a reduced height adjacent the second hub.

14. The cage of claim 9 wherein the first hub includes two longitudinally offset and adjacent half-hubs.

15. A cage for a roller cover, the cage comprising:

a plurality of hubs including a first hub centered about an axis and a second hub centered about the axis;

a first bridge spaced from said axis and spanning the first and second hubs, the first bridge including first and second opposite edges providing first and second roller cover support surfaces spaced from the axis, and configured to engage the roller cover;

a first longitudinal support member longitudinally extending along the first bridge non-parallel to the first bridge to provide a third roller cover support surface configured to engage the roller cover;

a second bridge spaced from said axis and spanning the first and second hubs, the second bridge having third and fourth opposite edges providing fourth and fifth roller cover supporting surfaces configured to engage the roller cover; and a second longitudinal support member longitudinally extending along the second bridge non-parallel to the second bridge to provide a sixth roller cover support surface configured to engage the roller cover, wherein the first and second bridges resiliently bias the third and sixth roller cover support surfaces into engagement with the roller cover.

16. The cage of claim 15 including at least one transversely extending roller cover support surface resiliently biased beyond at least one of the hubs to longitudinally flex when engaging the roller cover.

* * * * *